United States Patent [19]

Peavey et al.

[11] Patent Number: 4,522,101

[45] Date of Patent: Jun. 11, 1985

[54] MOUNTING RING AND THUMBREST

[75] Inventors: Hartley D. Peavey; Michael V. Powers, both of Meridian, Miss.

[73] Assignee: Peavey Electronics Corp., Meridian, Miss.

[21] Appl. No.: 434,869

[22] Filed: Oct. 18, 1982

[51] Int. Cl.[3] ..... G10H 3/00

[52] U.S. Cl. ..... 84/1.16; 84/1.14

[58] Field of Search ..... 84/1.14, 1.15, 1.16

[56] References Cited

U.S. PATENT DOCUMENTS

| | | | |
|---|---|---|---|
| 4,133,243 | 1/1979 | Di Marzio | 84/1.15 |
| 4,220,069 | 9/1980 | Fender | 84/1.15 |
| 4,227,434 | 10/1980 | Di Marzio | 84/1.14 |
| 4,283,982 | 8/1981 | Armstrong | 84/1.15 |
| 4,364,295 | 12/1982 | Stich | 84/1.15 |

*Primary Examiner*—Forester W. Isen

*Attorney, Agent, or Firm*—Berman, Aisenberg & Platt

[57] ABSTRACT

A mounting ring-thumbrest is provided for an electric guitar. The article provides a mounting ring for securing a pickup to the guitar and a thumbrest. The thumbrest is located to provide the optimum position of a player's hand.

A method of mounting a pickup uses only two screws to secure the mounting ring-thumbrest and pickup to the guitar and allows the space between the strings and the pickup to be adjustable.

6 Claims, 3 Drawing Figures

MOUNTING RING AND THUMBREST

TECHNICAL FIELD

This invention relates to the art of electric stringed instruments, particularly the art of mounting a transducer on an electric guitar.

BACKGROUND ART

An electric guitar employs a transducer to convert the vibrations of a string into an electronic signal which is subsequently amplified and directed to a speaker. The transducer is known in the art as a pickup and is typically placed in the body of the guitar beneath the strings of the guitar. The placement of the pickup affects the spectral content of the output signal. Typically, the pickup is placed in the guitar body so that the longitudinal axis of the pickup forms an oblique angle with the guitar strings. The pickup may be placed at almost any angle depending upon the choice of the designer.

Pickups have been mounted to the body of a guitar in various manners. One technique is to mount the pickup to the body of the guitar directly by using mounting screws which pass through the body of the pickup and into the body of the guitar. Another prior technique is to place a piece of foam between the pickup body and the guitar body and to secure the pickup by screws which pass through the pickup body and into the guitar body.

Another method of mounting a pickup is to employ a mounting ring. The mounting ring is secured to the guitar body by means of screws which pass through the mounting ring and into the guitar body. The pickup is then secured to the mounting ring by screws which pass through the mounting ring and into the body of the pickup.

Many guitars are played by the performer' plucking the strings with his fingers. A bass guitar is commonly played in this manner and, in particular, the hand is held above the strings so that each string is plucked by a finger. In order for the performer to maintain the proper position of his fingers, a thumbrest has been provided on the body of the guitar. The thumbrest is typically a piece of plastic which is mounted directly on the guitar body at a location adjacent the strings to provide the proper placement of the fingers when the thumb is resting on the thumbrest. This kind of thumbrest is not satisfactory since it requires additional holes to be drilled in the body of the guitar and is another small item to be manufactured and installed.

In some prior art guitars, the pickup is quite thick and extends above the top of the guitar body to such an extent that the pickup has been used as a support for the thumb of the performer. This technique has the disadvantage that extraneous vibrations from the performer's thumb are introduced to the pickup, thus degrading the quality of the output signal. Also, the pressure of the thumb eventually detaches the pickup from the guitar body.

STATEMENT OF THE INVENTION

The invention is a combination mounting ring and thunbrest. By providing a thumbrest as an integral part of the mounting ring, the expense and complication of providing a separate thumbrest are avoided. Since the thumbrest is part of the mounting ring, the thumb does not rest directly on the pickup. Unnecessary forces and vibrations on the pickup are thus avoided.

The invention also comprises a method and apparatus for attaching a pickup to a guitar body, wherein only two screws are required to attach the mounting ring, thumbrest, and pickup to the guitar.

It is an object of this invention to provide a mounting ring for mounting the pickup to an electric guitar body and for simultaneously providing a thumbrest for the thumb of a performer's hand.

It is a further object of this invention to provide a method and apparatus for mounting a pickup on the body of an electric guitar.

It is a further object of this invention to provide a thumbrest for an electric guitar which provides the player with the optimum hand position.

It is a further object of this invention to provide a mounting ring and thumbrest which are integrally formed.

DETAILED DESCRIPTION OF THE DRAWINGS

Figure 1:
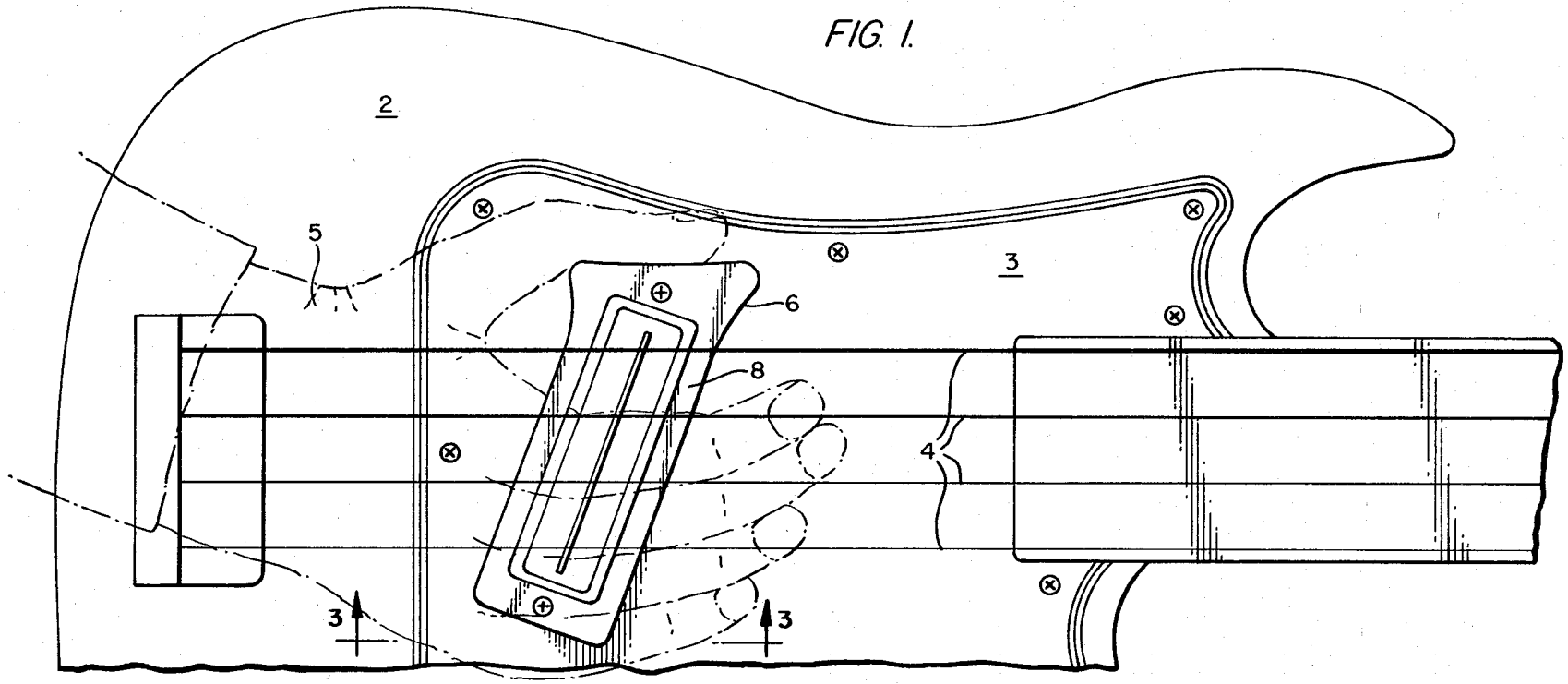
FIG. 1 is a view of an electric bass guitar showing the mounting ring-thumbrest in an operative position.

FIG. 1 shows an electric guitar having a body 2, pickguard 3, and strings 4. A pickup 6 is shown mounted on the guitar body beneath the strings 4. The pickup 6 is shown as forming an oblique angle with the strings 4, but the orientation may differ depending upon the particular installation. The pickup 6 is mounted to the guitar 2 by means of a mounting ring-thumbrest 8. The hand 5 of a guitarist is shown, in phantom lines, with the thumb resting on the mounting ring-thumbrest and the fingers above the strings 4.

Figure 2:
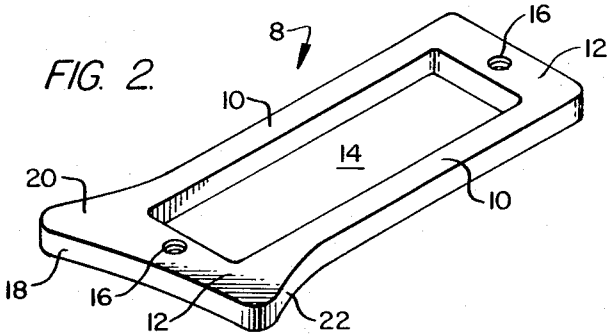
FIG. 2 is a perspective view of the mounting ring-thumbrest of the invention.

FIG. 2 shows a perspective view of the mounting ring-thumbrest 8 of the invention. The mounting ring-thumbrest is an integral element, having a generally rectangular portion formed by sides 10 and ends 12. A cavity 14 is provided to receive the pickup 6. Holes 16 are located in respective ends 12 for securing the mounting ring-thumbrest and pickup to the guitar in a manner which will be more fully explained with regard to FIG. 3. One end of the mounting ring-thumbrest is contoured to provide a thumbrest. Thumbrest surface 18 is slightly concave, and portions 20 and 22 extend from the sides 10 to provide a thumbrest area which is wider than the remainder of the mounting ring-thumbrest.

As seen in FIG. 1, the surface 18 lies in the general direction of the strings 4 when the mounting ring-thumbrest is attached to a guitar. This provides an appropriate rest for the performer's thumb. The exact relationship between the direction of the surface 18 and the location of the cavity 14 will depend upon the chpsen relationship between the pickup and the guitar strings, and the most comfortable orientation of the surface 18. In the preferred embodiment shown in the figure, the cavity 14 is rectangular, and the surface 18 is not perpendicular to the longitudinal axis of the cavity 14.

Figure 3:
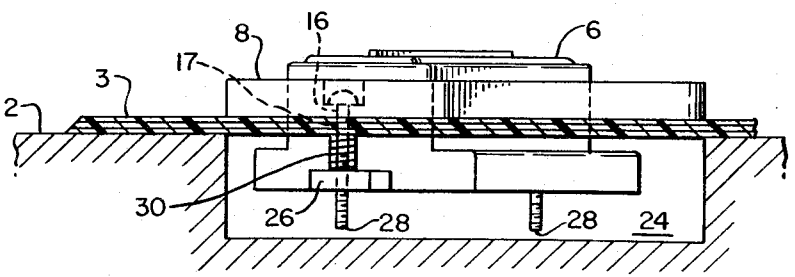
FIG. 3 is a cross-section of a guitar taken along line 3—3 of FIG. 1.

FIG. 3 shows how a pickup may be mounted in accordance with another feature of the invention. The pickup 6 extends above and below the pickguard 3. Below the pickguard 3, the pickup is received in a cavity 24 in the body of the guitar. The pickup 6 has a tab 26 on each end of the portion of the pickup which extends into the cavity 24. These tabs 26 are typically threaded to receive mounting screws 28. According to the present invention, the mounting ring-thumbrest and pickup may both be secured to the guitar by means of only two screws 28. Each screw 28 extends through a respective hole 16 in the mounting ring-thumbrest, hole 17 in the pickguard, and into a respective tab 26. Springs 30 are placed between the upper surface of the tabs 26 and the lower surface of the pickguard 3. These springs are of sufficient strength to secure the mounting ring-thumbrest and pickup to the guitar without the necessity of additional screws, such as those commonly employed in the prior art to secure the mounting ring to the pickguard. The distance between the pickup and the strings is adjustable by means of screws 28. When these screws are rotated, tabs 26 will move along the screws, thus raising or lowering the pickup 6 and affecting the output signal.

The mounting arrangement described above is quite advantageous because the thumb is allowed to rest on the mounting ring-thumbrest instead of directly on the pickup. The pickup is thus isolated from the vibrations of the performer's thumb, the pickup is not apt to become detached by the force of the thumb, and the hand of the performer is in the proper position.

Since this mounting arrangement employs only two screws, it is advantageous even when used with a mounting ring without an integral thumbrest. The mounting ring need not be separately attached to the guitar body, and the saving of assembly time and expense results.

A mounting ring-thumbrest has been described which provides a unique method of attaching a pickup to an electric guitar and also provides a thumbrest which is inherently properly located with respect to the strings and which does not require separate mounting to the guitar. Other objects and advantages will become apparent to those of ordinary skill in the art.

It is claimed:

1. A mounting ring-thumbrest for an electric stringed instrument comprising:

mounting means for receiving a pickup means, and adapted to be attached to a body of the instrument, and thumbrest means for supporting the thumb of a person playing said instrument, said thumbrest means being integrally formed with said mounting means, wherein said mounting means forms an elongate cavity for receiving said pickup, and said thumbrest means is located at one end of said mounting means and provides a concave surface for receiving said thumb.

2. The combination of claim 1 wherein said cavity is rectangular, and said surface intersects the longitudinal axis of said hole other than perpendicularly.

3. The combination of claim 2 wherein said thumbrest means is wider than said mounting means.

4. The combination of claim 1 further comprising means for mounting said mounting ring-thumbrest consisting of two holes formed in said mounting ring-thumbrest, and screw means for passing through said holes and cooperating with said pickup means to secure said mounting ring-thumbrest and pickup to said stringed instrument.

5. The combination of claim 4 wherein said means for mounting further includes elastic means between said pickup and said instrument for holding said mounting ring-thumbrest and pickup to said instrument while allowing said pickup to be adjustable relative to said instrument.

6. A stringed musical instrument comprising pickup means for detecting vibrations of a string, said pickup means having means for receiving a mounting screw, body means having a cavity receiving said pickup means therein, said body means having a first hole, mounting ring means at least partially surrounding said pickup means, said mounting ring means having a second hole, and spring means, wherein said mounting screw extends through said first and second holes, said spring means and into said means for receiving, and wherein said spring means extends between said means for receiving and said body means whereby said mounting ring and pickup means are secured to said body means by said screw means and said spring means.

* * * * *